US005762443A

United States Patent [19]

Gelfand et al.

[11] Patent Number: 5,762,443

[45] Date of Patent: Jun. 9, 1998

[54] GROUND RETRACTABLE AUTOMOBILE BARRIER

[75] Inventors: Matthew A. Gelfand; James C. Herrmann, both of Rockville Centre; John M. R. Fitzgerald, Stony Brook; Joseph Vellozzi, Ardsley, all of N.Y.; Joel L. Stahmer, Pennington, N.J.

[73] Assignee: Universal Safety Response, Inc., Rockville Centre, N.Y.

[21] Appl. No.: 606,600

[22] Filed: Feb. 26, 1996

[51] Int. Cl.[6] ..... E01F 13/04; B61L 29/00

[52] U.S. Cl. ..... 404/6; 256/13.1; 246/473.1; 49/9; 49/131

[58] Field of Search ..... 404/6, 9, 10, 11, 404/12, 14; 49/9, 34, 49, 131; 246/127, 473.1; 256/1, 13.1, 32

[56] References Cited

U.S. PATENT DOCUMENTS

| | | | |
|---|---|---|---|
| 1,344,776 | 6/1920 | Strieter . | |
| 1,437,404 | 12/1922 | Donovan | 49/34 |
| 1,661,051 | 2/1928 | Siano . | |
| 1,818,824 | 8/1931 | Strauss . | |
| 1,929,859 | 10/1933 | Strauss | 246/473.1 |
| 2,189,974 | 2/1940 | Buford . | |
| 2,219,127 | 10/1940 | Buford . | |
| 2,237,106 | 4/1941 | Minert . | |
| 2,251,699 | 8/1941 | Banschbach . | |
| 2,336,483 | 12/1943 | Hoover . | |
| 4,490,068 | 12/1984 | Dickinson | 404/6 |
| 4,509,577 | 4/1985 | Priefert | 160/328 |
| 4,780,020 | 10/1988 | Terio | 404/6 |
| 4,824,282 | 4/1989 | Waldecker | 404/6 |
| 5,118,056 | 6/1992 | Jeanise | 246/127 |

*Primary Examiner*—James Lisehora
*Attorney, Agent, or Firm*—Saidman DesignLaw Group

[57] ABSTRACT

A heavy duty shock absorber system for resisting large forces as may be encountered, for example, in a restraining barrier for a railroad crossing. A concrete bunker with an upstanding concrete-filled steel pipe has a hydraulic, compressive shock absorber mounted on the steel pipe for rotational, axial, and orthogonal movement. Forces applied to the shock absorber always pass through the axis of the steel pipe, thereby maximizing the resistance to the force while minimizing the necessary size of the system. A net is stored in a pit transverse the roadway parallel to the railroad tracks and is raised and lowered as appropriate. Each end of the net is attached to shock absorbing systems of the type described above.

18 Claims, 8 Drawing Sheets

GROUND RETRACTABLE AUTOMOBILE BARRIER

BACKGROUND OF THE INVENTION

I. Field of the Invention

This invention relates generally to apparatus designed to prevent motorists from crossing a railroad track while the warning gates are down or there is a train in the area, and more particularly to an automatically deployed restraining barrier for installation across a roadway adjacent to a railroad crossing for preventing intentional or unintentional crossing of the tracks while a train is approaching or passing through.

II. Description of Related Art

The following patents are representative of the endeavors of other inventors to develop a restraining barrier for preventing an automobile from crossing a railroad track, approaching a raised drawbridge, running off the end of a ferry, or entering a restricted area:

Strieter, U.S. Pat. No. 1,344,776, and Siano, U.S. Pat. No. 1,661,051, disclose railroad gates which are normally stored in a pit extending across the roadway parallel to a railroad track and which are raised into an obstructing position across the roadway. These gates are solid, being made of struts, bars, rods, or other solid pieces, and as such do not yield under impact. They act as immovable objects which can cause considerable damage to vehicles which collide with them and considerable harm to the occupants of those vehicles.

Strauss, in U.S. Pat. Nos. 1,818,824 and 1,929,859, provides a flexible, net-like barrier for a railroad crossing which drops from the top of a pair of posts into position to block the roadway. Cables connected to each end of the net are wound around a drum having a return spring. Collisions with the net unwinds the cables against the return spring bias which permits the net to yield, providing a cushioning effect which lessens the damage to the car and its occupants. The drums are raised and lowered on slides keyed to one wall of posts fixed to the ground. The strength of the system may have been adequate for automobiles of the 1930s, but the sliding drums could never sustain the impact forces caused by the speeds common in today's automobiles.

Buford, in U.S. Pat. Nos. 2,189,974 and 2,219,127, shows a railroad crossing gate made of wire mesh surrounded by a seemingly solid collar. Motor-driven cables raise and lower the gate on hollow posts embedded in a foundation in the ground. Impacts are resisted progressively by means of weights on an extensible cable system having a considerable number of moving parts, mainly the pulleys which guide and support the cables and weights. The wear and tear on these moving parts make maintenance a frequent and costly occurrence.

Minert, U.S. Pat. No. 2,237,106, discloses a highway barrier comprising a flexible net whose cables are wound onto a pair of drums. An oppositely wound pair of cables compress springs in a pair of underground tubes to retard the movement of the vehicle which hits the net. Banschback, U.S. Pat. No. 2,251,699, shows a railroad crossing gate made entirely of wire cables with no solid parts. The gate deflects under impact against the restraining force of a pair of spring tubes 16 running parallel to the roadway on both sides thereof. Hoover, U.S. Pat. No. 2,336,483, shows a deflectable railroad crossing barrier consisting of a net made entirely of wire cables. The net is connected at each end to a telescoping spring tube embedded in the ground parallel to the roadway. Each of these systems requires costly construction in order to embed the shock-absorbing spring tubes in the ground.

Waldecker, U.S. Pat. No. 4,824,282, shows a roadway barrier to stop terrorist intrusions into restricted spaces. A flexible net and inflatable airbags are located in a pit transverse of the roadway. When inflated the airbags raise the net, positioning it across the entire road. The ends of the net are connected to heavy-duty shock absorbers buried in concrete in the ground on both sides of the roadway. The shock absorbers include springs and/or fluids to dissipate the force of the impact while permitting deflection of the net. The cost of excavation and construction necessary to build this system may be worthwhile when limited to military bases, diplomatic compounds, or the like, but it is prohibitive when applied to the number of railroad crossings which should be protected by a restraining barrier.

OBJECTS AND SUMMARY OF THE INVENTION

The present invention overcomes the difficulties described above by providing a restraining barrier of simple design, low construction costs, and improved ruggedness.

The present invention accomplishes the above by providing a shock absorbing system which requires comparatively little excavation on site, which has relatively few elements, which has all the moving parts readily accessible for replacement or repair, and which maximizes both efficiency and ruggedness. Further, the present invention comprises a compact restraining barrier which includes a novel heavy duty shock absorbing system.

The foregoing and other objects are achieved in accordance with one aspect of the present invention through the provision of a shock absorbing system, comprising support means for providing a rigid support for the shock absorbing system, the support means including an axis, shock absorbing means mounted on the rigid support means for absorbing forces applied to the shock absorbing system, and force applying means connected to the shock absorbing means for applying forces to the shock absorbing means, the latter being mounted on the support means such that the applied forces act substantially through the axis of the support means. More specifically, the shock absorbing means is preferably mounted for rotation about he axis of the support means. The shock absorbing means is also preferably linearly translatable relative to the axis, substantially orthogonal to the axis and/or substantially axially of the axis.

In accordance with other aspects of the present invention, the support means preferably comprises a rigid foundation and a cylinder embedded into the foundation, the above-mentioned axis being the axis of the cylinder. The shock absorbing means preferably comprises a sleeve mounted on the cylinder for axial and rotational movement relative thereto, a collar mounted on the sleeve for orthogonal movement relative thereto, and a shock absorber operatively connected to the sleeve and the collar. Even more particularly, the shock absorber is preferably hydraulic and is compressive in response to the applied forces.

In accordance with other aspects of the present invention, there is provided a ground retractive automobile barrier which comprises the above-discussed shock absorbing system installed on both sides of a roadway adjacent the roadway as well as on both sides of railroad tracks that cross the roadway adjacent the railroad tracks. Restraining means, preferably in the form of a net, extends across the roadway between the shock absorbing systems on each side of the railroad tracks.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

DETAILED DESCRIPTION OF THE PREFERRED EMBODIMENT

Figure 1:
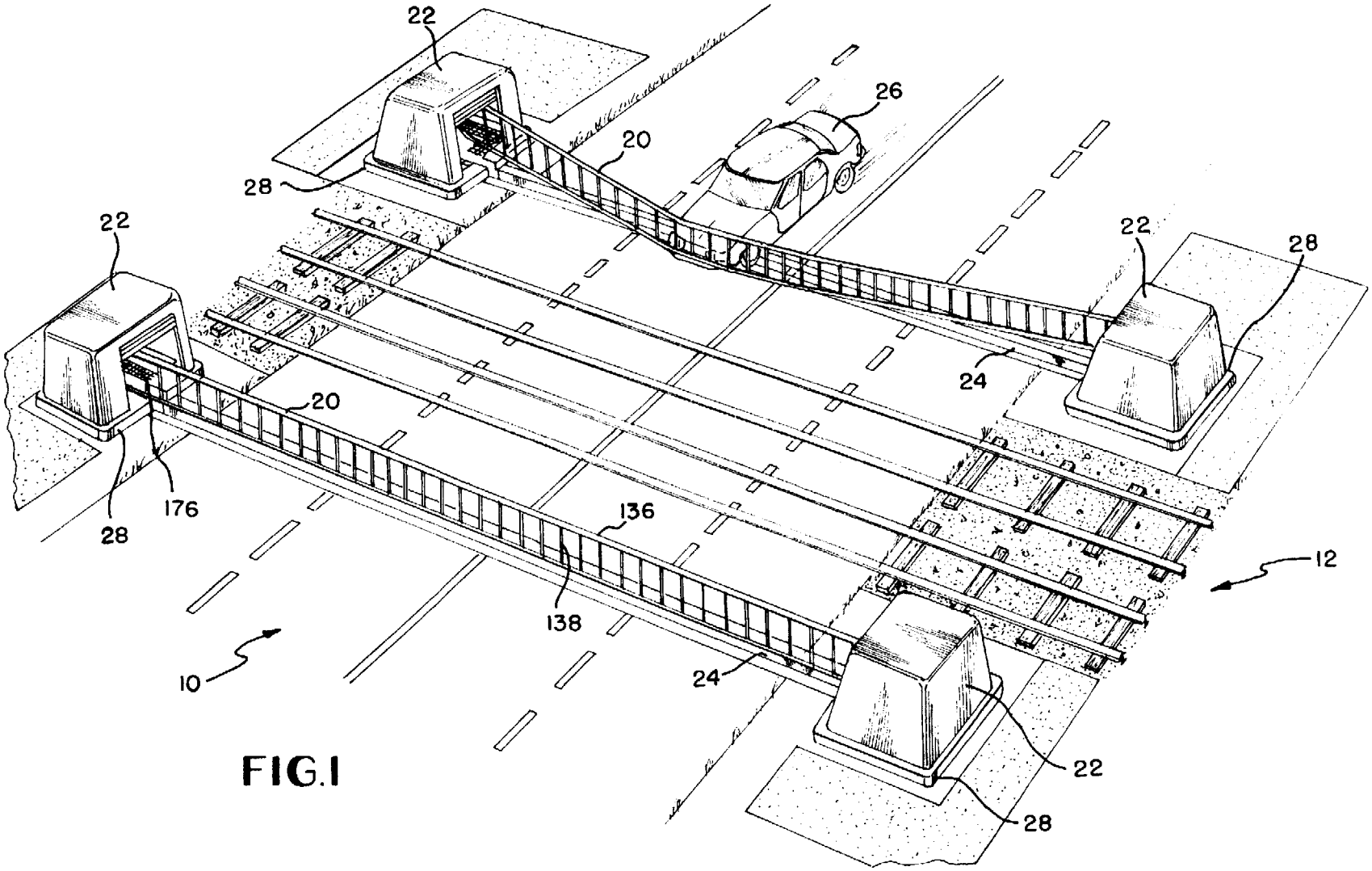
FIG. 1 is a perspective view which illustrates a railroad crossing for a multi-lane roadway with a preferred embodiment of the present invention installed and restraining an automobile.

Referring now to the drawings, wherein like reference numerals represent identical or corresponding parts throughout the several views, and more particularly to FIG. 1, a general layout of the present invention is shown as it would appear installed at a typical railroad crossing comprising a roadway indicated generally by reference numeral 10 and railroad tracks indicated generally by reference numeral 12. A pair of capture nets 20 are stretched across roadway 10 parallel to tracks 12, each such capture net 20 extending between a pair of housings 22 located on opposite sides of roadway 10. Housings 22 enclose the mechanisms, to be described in greater detail hereinafter, for raising and lowering nets 20. Such mechanisms are under the control of a train-detecting means (undisclosed) which forms no part of the present invention. Each housing 22 covers a support means 28 which provides support and stability for the present invention.

Each net 20 is normally preferably stored in a slot 24 that extends transversely across roadway 10 between housings 22. Shown at the top of FIG. 1 is a vehicle 26 which has crashed into net 20 and is restrained by net 20 to prevent it and its occupants from being on tracks 12 when the train passes through. Net 20 has been deflected by the collision from its quiescent state (shown by the net 20 at the bottom of FIG. 1) so as to form a shallow "V" shape. The ability to be deflected, yet provide a restraining force, allows vehicle 26 to be progressively stopped, thereby lessening adverse effects of the impact forces acting on vehicle 26 and its occupants. The deflecting and restraining functions are achieved by a unique shock absorbing system of the present invention, to be described in greater detail hereinafter.

Figure 2A:
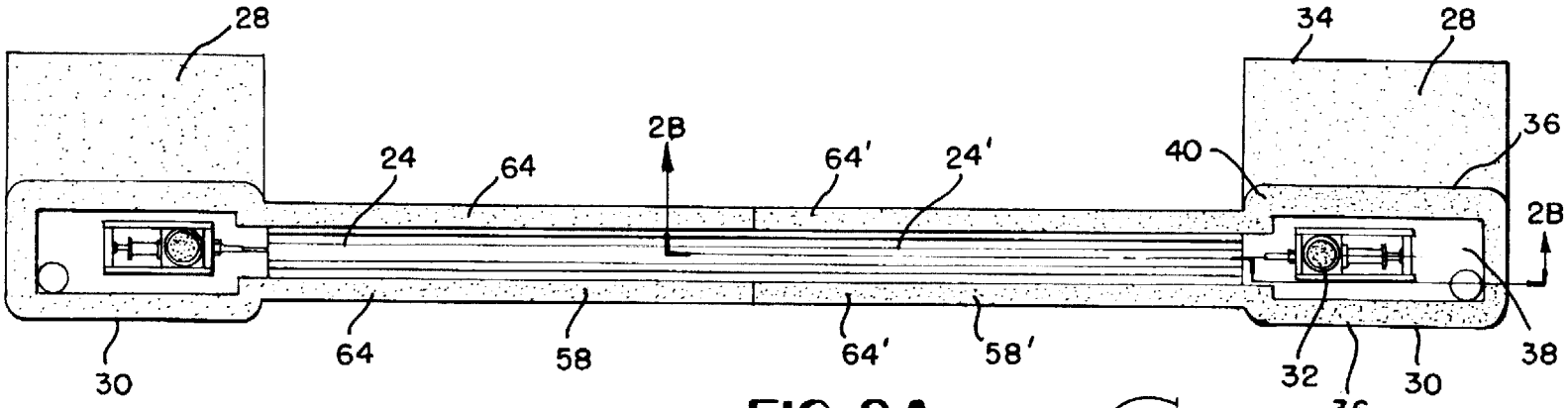
FIG. 2A is a top view, partially cut away, of a barrier as it would appear on one side of the railroad track.
Figure 2B:
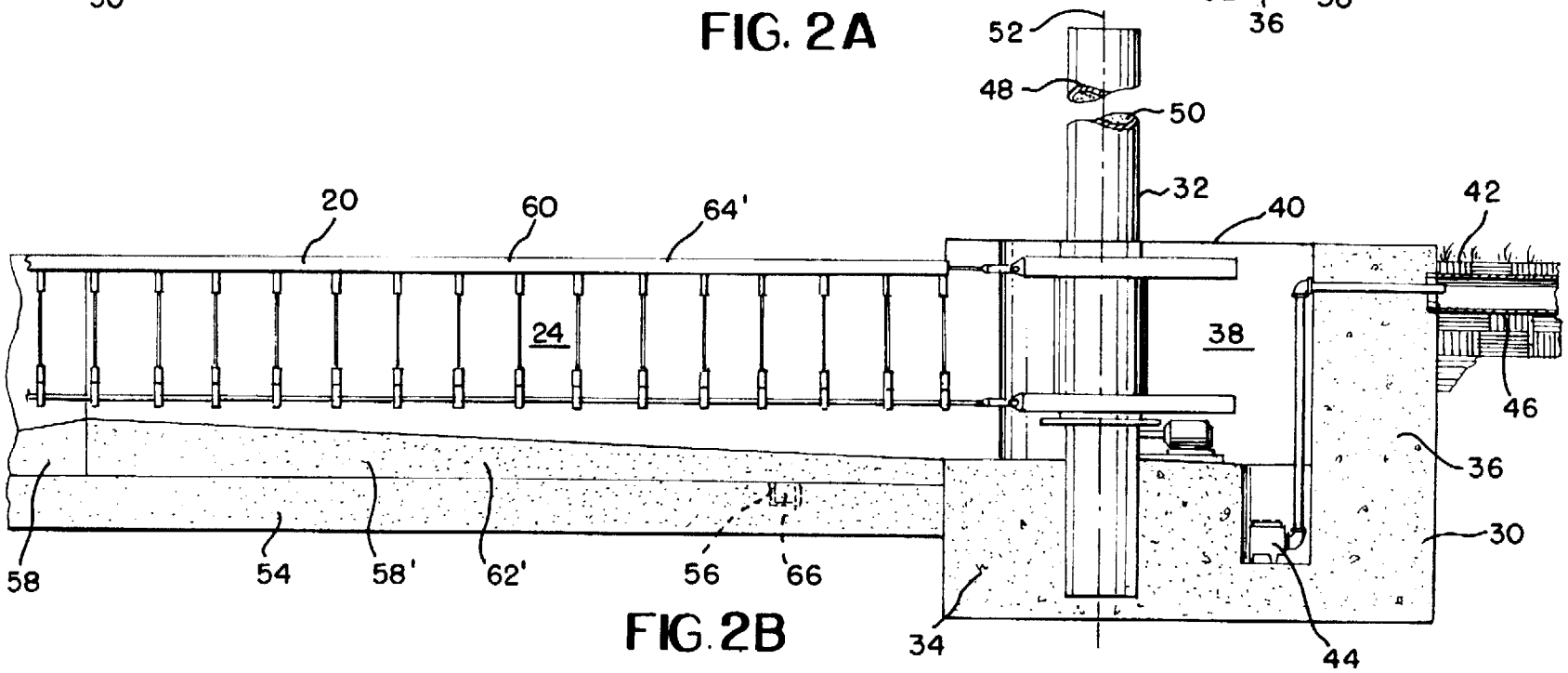
FIG. 2B is a side view, partially in section, of a net slot and supporting foundation, a bunker, a net, and a pair of shock absorbing mechanisms.

Referring now to FIGS. 2A and 2B, there is shown in greater detail the support means 28 of the present invention. A top, sectional view of the present invention is shown in FIG. 2A with roadway 10 and housings 22 removed. FIG. 2B shows a side view, partially in section, along the lines 2B—2B of FIG. 2A.

Support means 28 comprises a massive concrete bunker 30 and a stanchion 32. Bunker 30 is poured at the site on each side of roadway 10 and comprises a foundation 34 and upstanding bunker walls 36. Walls 36 define in bunker 30 a pit 38 which is open upwardly toward roadway 10. Foundation 34 may typically, for example, be twelve feet square by nine feet deep. The top 40 of walls 36 are preferably about six inches above ground level 42 to provide a protective curb around bunker 30. A sump pump 44 is preferably provided to remove any water which might accumulate in pit 38 into a drainage pipe 46.

Stanchion 32, which typically may comprise a twenty-five inch steel pipe 48, is filled with concrete 50 and is preferably embedded approximately four feet deep in foundation 34 at the bottom of pit 38 and extends five to six feet above the top of foundation 34. Stanchion 32 has an axis 52, whose importance will become clear hereinafter.

Foundation 34 and walls 36 are of solid concrete having no moving parts. As such, once bunker 30 is poured in place, it does not need to be serviced or repaired. Prior art restraining means have traditionally disclosed extensive structure buried parallel to roadway 10 to house the shock absorbing pistons, weights, or springs, all of which required expensive excavation of the site to repair or replace the essential moving parts of the restraining means. Because of the size and mass of bunker 30, it provides a solid support means which effectively resists all the forces imposed upon it by deployment and use of the present invention.

Also poured at the site is a concrete roadway foundation 54 which extends completely across roadway 10 to another bunker 30, not described in detail, since all bunkers 30 are identical. Roadway foundation 54 includes at least one key slot 56 which comprises a recess of any convenient size and shape, for a purpose to be described hereinafter.

Roadway foundation 54 supports a pair of pre-cast, concrete structures 58, 58' which comprise the net slots 24, 24' in the roadway into which net 20 is lowered for storage. As shown in FIG. 2B, the top 60 of net slots 24, 24' are at ground level 42, so that they are flush with the surface of roadway 10. Structures 58, 58' form essentially a pair of net slots 24 and 24' which are shown end to end in FIGS. 2A–2B. Each of structures 58, 58' are substantially U-shaped having a base 62, 62' and a pair of upstanding arms 64, 64' defining slots 24, 24'. Inasmuch as concrete structures 58 and 58' are mirror images, otherwise being identical, they and the parts thereof will hereinafter be referred to without the primes to avoid overly complicating the specification.

Figure 8:
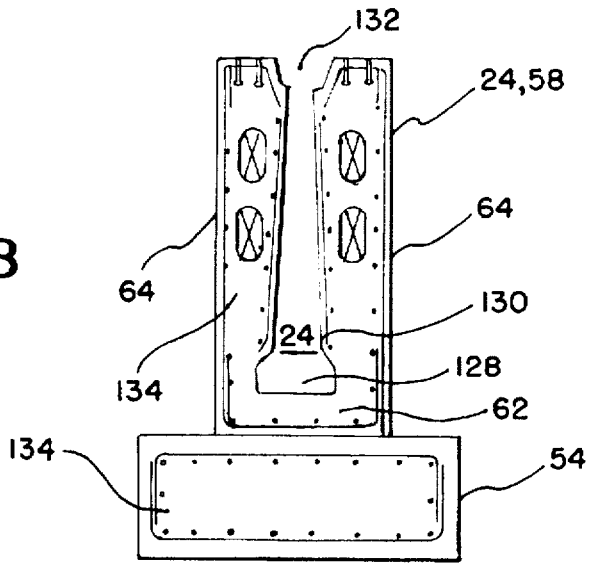
FIG. 8 is a sectional view of a net storage slot and foundation.

FIG. 8 shows a cross-sectional view of net slot 24 (comprising concrete structure 58) and roadway foundation 54. As noted above, concrete structure 58 is essentially U-shaped having upstanding arms 64 connected by a base 62. Net slot 24 has a cross-sectional shape that includes an enlarged base 128 for improved drainage, upwardly converging side walls 130 to guide capture net 20 upwardly for deployment, and a concave seat 132 opening to roadway 10. Concrete reinforcement, shown diagrammatically at 134, is provided in conformance with industry standards.

The partial cross-section shown in FIG. 2B bisects slot 24 and pit 38. Net 20 and the shock absorbing system are shown in their broad features; they will be described and shown in greater detail hereinafter. The upper surface of base 62 slopes toward pit 38 to permit runoff from accumulating in slot 24, where it might freeze and obstruct the smooth operation of the present invention; the slopes shown in FIG. 2B are exaggerated for clarity. The concrete structures 58 that form net slots 24 are pre-cast elsewhere and then transported for emplacement in the roadway. Base 62 of net slot 24 has at least one downwardly extending key 66 which is of a complementary size and shape to key slot 56. Key 66 aids in aligning the present invention with roadway foundation 54 and resists any shearing movement of concrete structure 58 relative to roadway foundation 54. After key 66 has been fit into key slot 56, key slot 56 is preferably grouted solid. Pre-casting the concrete structure 58 and providing it with key 66 simplifies the construction at the site, thereby reducing construction costs.

Figure 3:
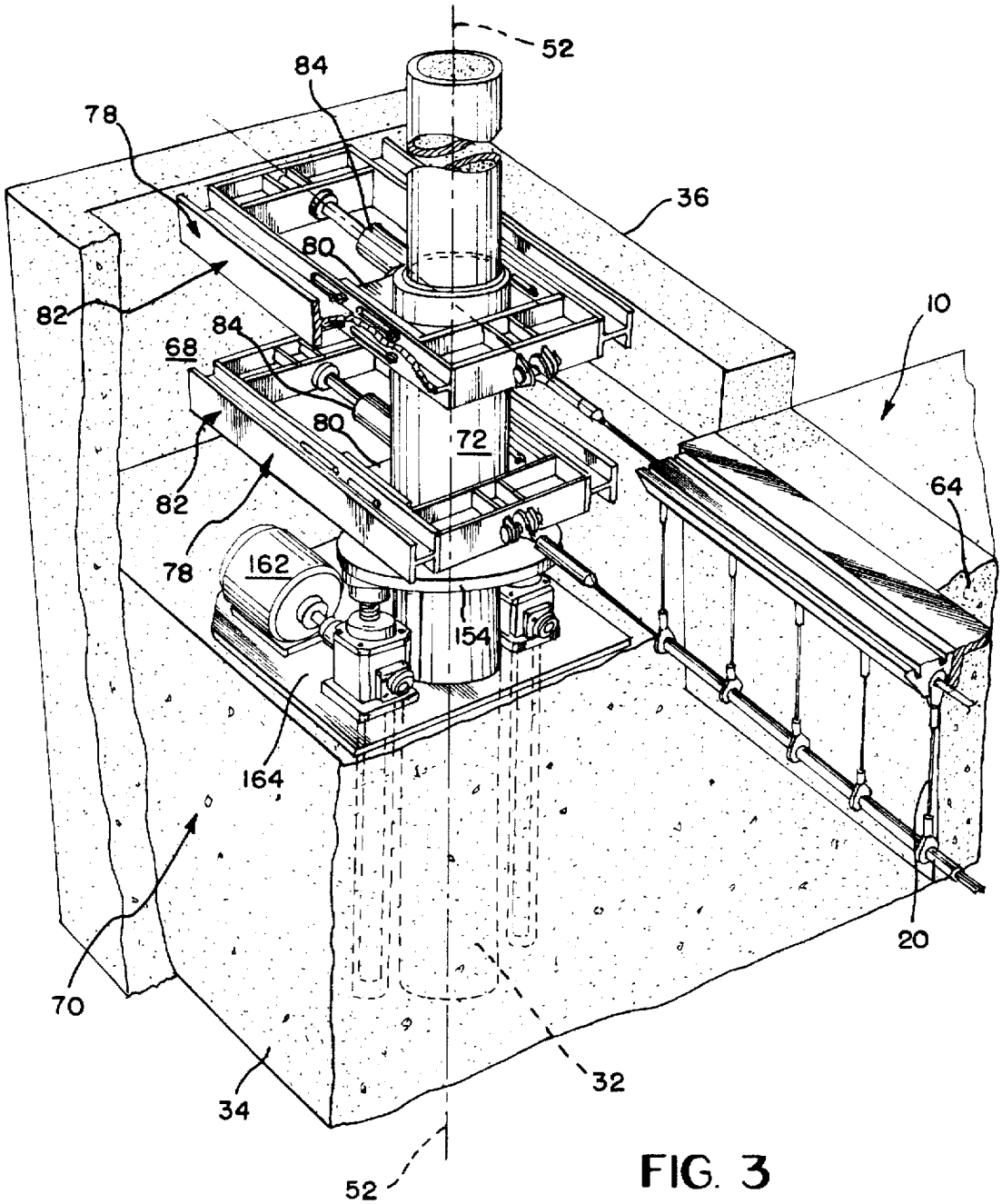
FIG. 3 is a perspective view of a preferred embodiment of one of the shock absorbing systems according to the present invention, shown partially cut away, with a bunker foundation.
Figure 4:
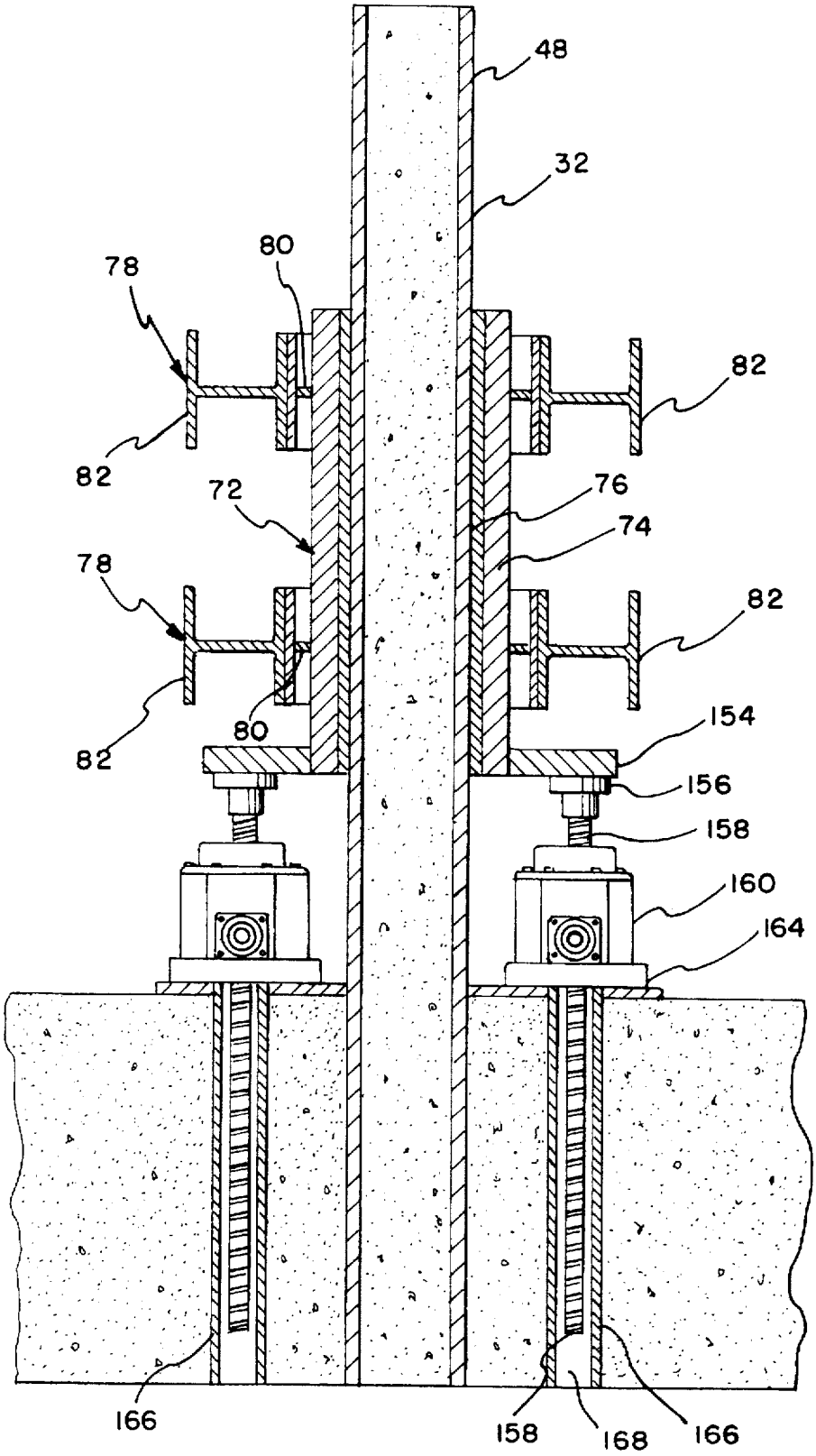
FIG. 4 is a sectional view of a bunker stanchion, part of the mounting collar of the shock absorbing system, and net raising and lowering jacks.
Figure 5:
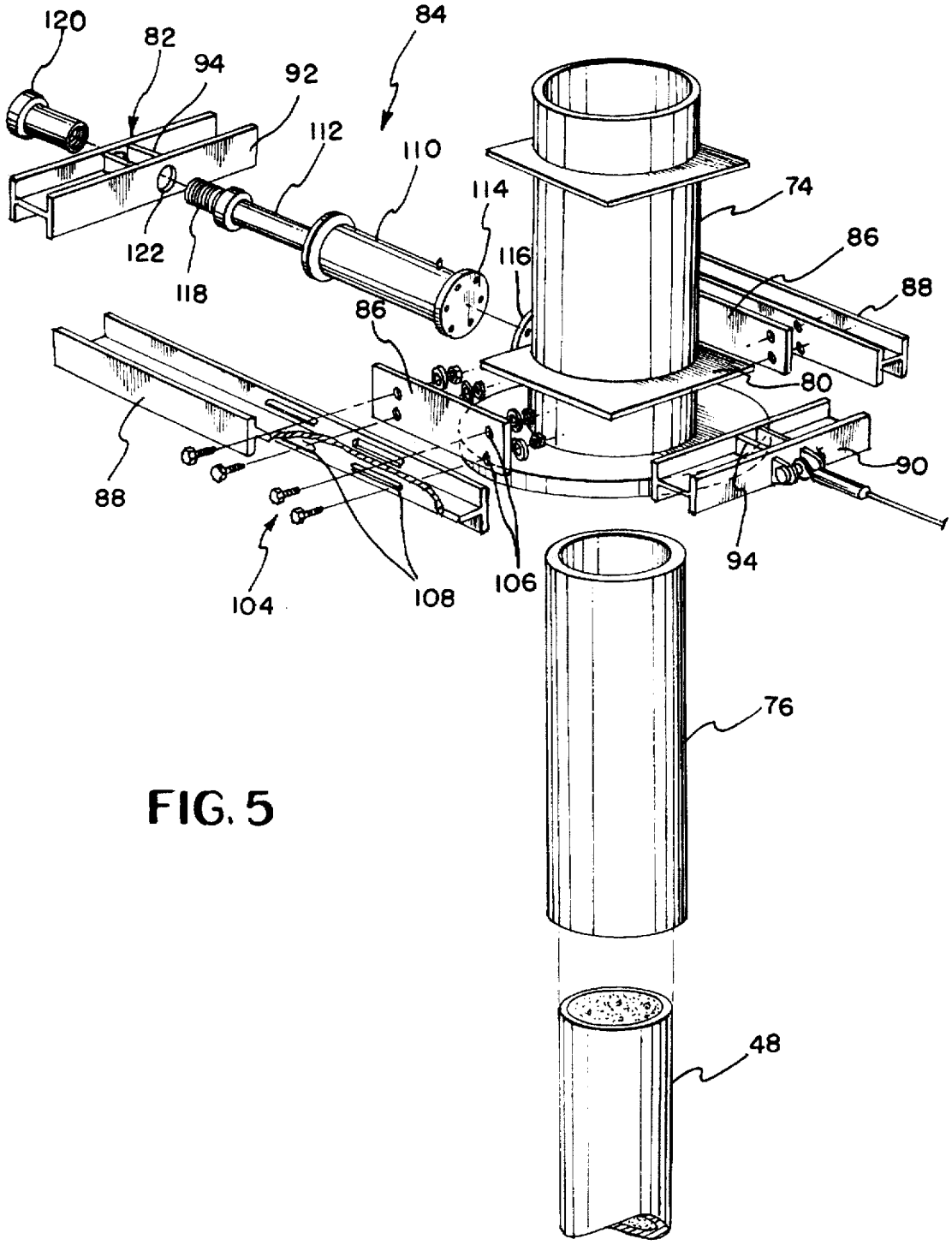
FIG. 5 is an exploded, perspective view of the shock absorbing system and stanchion.

Referring to FIGS. 3, 4, and 5, the inventive shock absorbing system is shown, respectively, in perspective, cross-sectional, and exploded views. A preferred embodiment of the shock absorbing system is indicated generally by reference numeral 68 and comprises essentially a bearing sleeve 72 which is rotatable and vertically slidable on stanchion 32, a pair of collars 82 horizontally slidable relative to bearing sleeve 72, and a pair of shock absorbers 84 mounted between collars 82 and bearing sleeve 72.

The perspective view of FIG. 3 shows roadway 10, a portion of net 20 lowered into roadway 10, foundation 34, bunker walls 36, one arm 64 of net slot concrete structure 58, shock absorbing system 68, and a net lift mechanism indicated generally by reference numeral 70 and which will be described in greater detail hereinafter.

Figure 12:
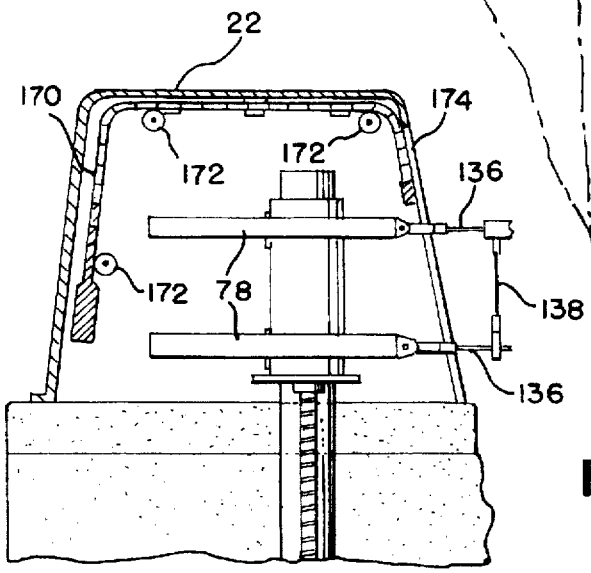
FIG. 12 is a sectional view of a housing over the bunker and shock absorbing system.

As before noted, stanchion 32 is embedded in foundation 34, thereby fixing in concrete the location of axis 52. Slidable vertically on stanchion 32 is bearing sleeve 72. Preferably, as seen in FIGS. 4 and 5, bearing sleeve 72 comprises a galvanized steel sleeve 74 with a lubrite bronze insert 76 press fit therewithin which is reamed to fit externally milled stanchion 32. In FIG. 5, insert 76 is shown separate from steel sleeve 74 to show they are separate elements; in practice they are essentially integral with each other. Mounted on bearing sleeve 72, one above the other, are two shock absorbing mechanisms 78 (FIGS. 3, 4, and 12). Only the lower one is shown in FIG. 5 for simplicity in explaining its structure, and since both shock absorbing mechanisms 78 are identical, only one need be described in detail.

Each shock absorbing mechanism 78 comprises a mounting plate 80 fixed to steel sleeve 74, a shock absorber collar 82 horizontally slidable relative to mounting plate 80, and a shock absorber 84 whose housing 110 (FIG. 5) is fixed to mounting plate 80 and whose piston 112 is fixed to collar 82. Shock absorber 84 biases collar 82 away from roadway 10 (FIG. 6A) and resists movement of collar 82 toward roadway 10, as will become more clear hereinafter.

As best seen in FIG. 5, mounting plate 80 is integral, by welding or otherwise, with steel sleeve 74. Plate 80 has flanges 86 integrally extending from opposite side edges thereof; additional flanges (not shown) may be provided on the front and back edges of plate 80 for stability, if desired. Shock absorber collar 82 is horizontally slidable relative to flanges 86. Shock absorber collar 82 preferably comprises an integral structure consisting of four I-beams: two side beams 88, a front beam 90, and a rear beam 92. Front beam 90 and rear beam 92 are reinforced by integral vertical partitions 94 against deformation due to shear forces imposed by net 20.

Figure 7:
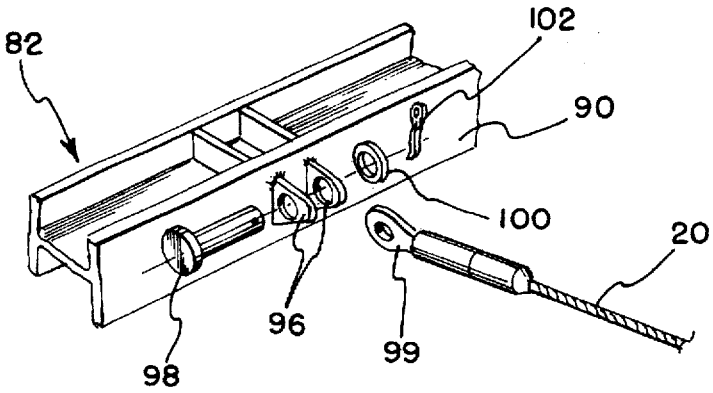
FIG. 7 illustrates one manner of connecting the net to a shock absorbing mounting collar.

As more clearly seen in FIG. 7, a pair of ears 96 are fixed to front beam 90 for attaching net 20 to collar 82. A pin 98 passes through aligned apertures in ears 96 and through the aperture in the swaged closed eye socket 99 connected to the ends of the horizontal cable of net 20. A washer 100 and a cotter pin 102 removably secure pin 98 in place. The connection shown is but exemplary of the many ways of attaching net 20 to collar 82.

Referring back to FIG. 5, bolts 104 pass through apertures 106 in flange 86 and are slidable in slots 108 formed in side I-beams 88, thereby permitting collar 82 to slide relative to flanges 86 of plate 80. Slots 108 are preferably about twelve inches in length. The top shock absorber collar 82 of FIG. 3, and the bottom shock absorber collar 82 of FIG. 5, are partially broken away to more clearly show slots 108. By providing vertically and horizontally aligned pairs of apertures 106 and slots 108, the relative movement between flanges 86 and collar 82 is constrained to being linear and horizontal.

Shock absorber 84 is preferably hydraulic with about a 50,000 pound resistance with a twelve inch stroke and an accumulator with a 5000 pound return force. Shock absorber cylinder 110 is removably mounted to the rear of plate 80, as noted above, by mounting plates 114–116. Shock absorber piston 112 is removably attached to rear I-beam 92 of collar 82. Preferably, the attachment is effected by means of a threaded extension 118 of piston 112 which is received in an internally threaded sleeve-bolt 120 which fits through aligned apertures 122 in rear beam 92, but this is only exemplary. For strength, sleeve-bolt 120 passes between partitions 94 in rear beam 92.

Maintenance of the present invention is facilitated by this construction, inasmuch as shock absorbing system 68 is easily accessible, the moving parts thereof being located in the open. With housing 22 removed, system 68 is either within or above pit 38, when retracted or raised, respectively. No excavating is necessary to effect replacement or repairs of worn or damaged parts. Only the support means, bunker 30 and stanchion 32, are required to be buried, and they do not need to be removed at all for any maintenance.

Figure 6A:
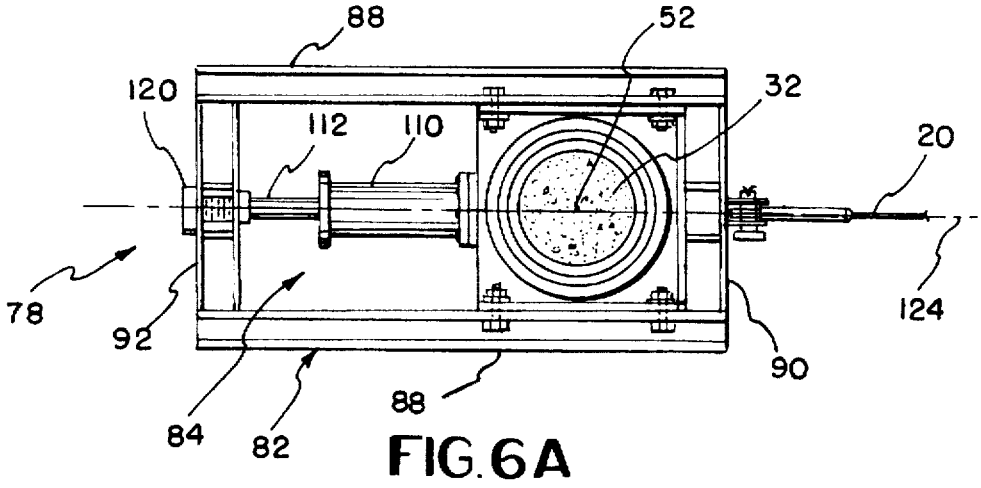
FIG. 6A is a top view of the shock absorbing system in its quiescent state.
Figure 6B:
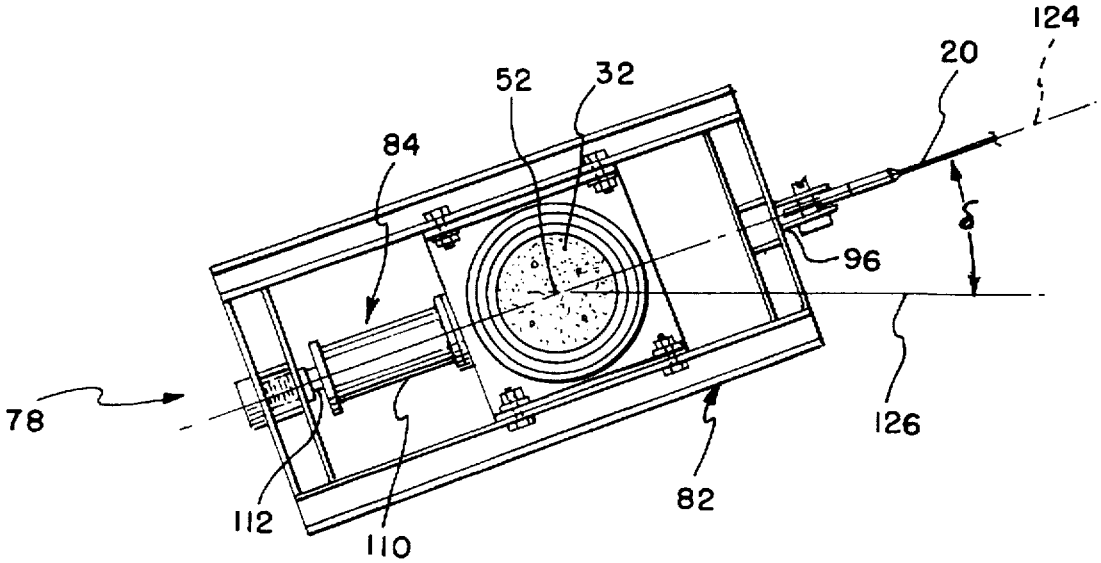
FIG. 6B is a top view of the shock absorbing system under strain after a vehicular collision with the net.

Referring to FIGS. 6A and 6B, shock absorber mechanisms 78 are shown in their quiescent state and their active state, respectively. Being top views, only the top shock absorber mechanism 78 is seen, the other lying directly beneath the one visible.

In the quiescent state (FIG. 6A), net 20 is stretched transversely across roadway 10 in the manner exemplified by bottom net 20 in FIG. 1. It is not subject to collision with any vehicle, so it is not performing its restraining function. Shock absorber 84 is normally in its expanded state, pushing collar 82 to the left in FIG. 6A to pull net 20 taut. The shock absorber 84 on the other side of roadway 10 will push to the right to cooperate in pulling net 20 taut. Typically, capture net 20 is installed with a 5000 pound pre-tension horizontal load on its cables.

Note that the longitudinal axes of shock absorber collar 82, shock absorber 84, and the plane of net 20 include axis 124 which ideally passes through axis 52 of stanchion 32. Thus, when net 20 pulls on collar 82, the force vectors act along axis 124 through stanchion axis 52. 5 FIG. 6B shows shock absorbing mechanism 78 under strain after a vehicular collision, which, as shown in FIG. 1, deflects net 20 to form a shallow V. This deflection of net 20 rotates collar 82, plate 80, bearing sleeve 72, and shock absorber 84, through an angle δ (delta) between axis 124 and the original plane 126 of net 20. Since the plane of net 20 still includes axis 124, the tensile force of net 20 is still exerted along axis 124 of shock absorbing mechanism 78 through axis 52 of stanchion 32. It will be appreciated that this relationship holds regardless of the size of the angle δ, i.e., regardless of how much net 20 is deflected and thereby regardless of the rotational orientation of shock absorbing mechanism 78 relative to stanchion 32 and roadway 10. Since all of the forces imposed upon the present invention are directed along axis 124 and thereby through axis 52, all of the forces applied by net 20 are focussed through the center of stanchion 32, which is solidly anchored in foundation 34. Therefore, all of the forces required to be resisted by the present invention are centrally aligned with the maximum resistive strength of stanchion 32 and bunker 30. This permits the present invention to be constructed of a relatively compact size while being optimally effective in resisting applied forces.

As well as rotating due to the deflection of net 20, the forces applied by net 20 exerts tensile forces which slide collar 82 horizontally relative to stanchion 32, to the right in FIG. 6B. This relative motion is permitted by bolts 104 being fixed in apertures 106 in flanges 86 of plate 80 and slidable in slots 108 in side beams 88. Shock absorber 84 resists and absorbs these tensile forces by piston 112 compressing the hydraulic fluid in cylinder 110 (FIG. 6B) due to collar 82 sliding relative to stanchion 32.

Figure 10:
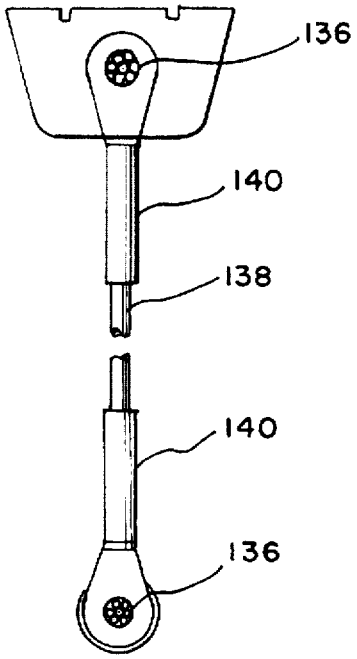
FIG. 10 is a front, partially broken view of the net showing the net plug and one of the net's vertical strands.
Figure 11:
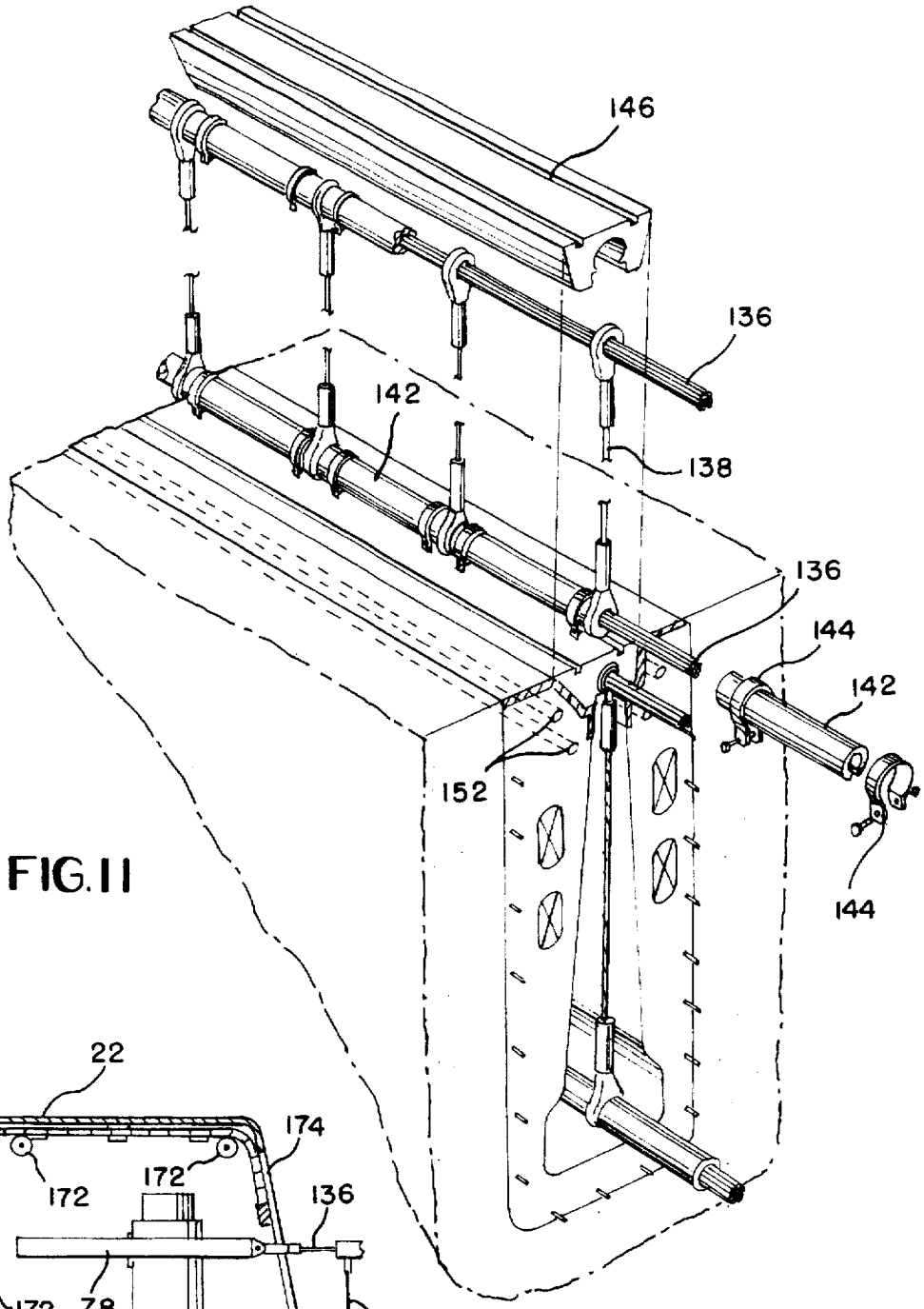
FIG. 11 is an exploded perspective view of the net structure, the sectional view of the net storage slot being shown in phantom.

Referring now to FIGS. 1, 3, and 10–12, the details of the net structure 20 will now be described. Net 20 preferably comprises a pair of horizontally extending structural cables 136 connected by a plurality of vertically extending cables 138. Horizontal cables 136 are preferably one inch galvanized structural strands with a minimum breaking strength of sixty-one tons. Vertical cables 138 are preferably five-eighths inch galvanized structural strands with a minimum breaking strength of twenty-four tons. As best seen in FIG. 10, vertical strands 138 are connected to horizontal strands 136 through swaged sockets 140. Elastomeric spacers 142 (FIG. 11) are clamped to horizontal strands 136 by stainless steel clamps 144 to maintain proper spacing between vertical strands 138.

Figure 9:
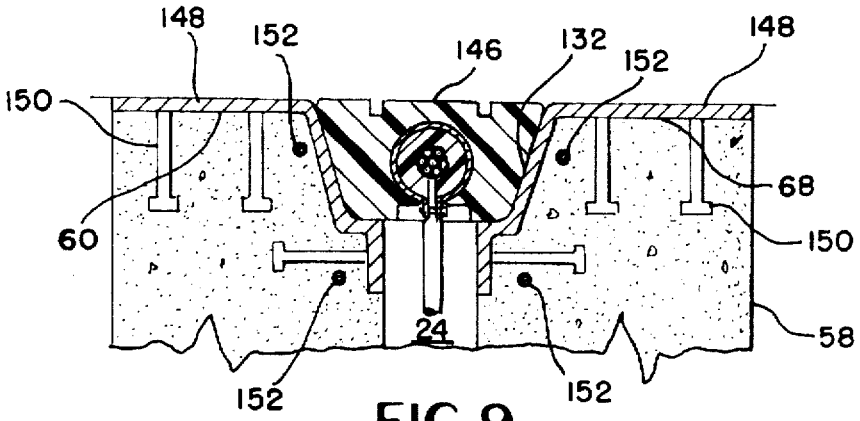
FIG. 9 is an enlarged sectional view of an upper portion of the net storage slot with a net plug in place.

A flexible, elastomeric plug 146 is preferably snapped over the top horizontal cable 136. As best seen in FIG. 9, plug 146 is shaped complementary to a concave seat 132 formed in the top of slot 24 to seal slot 24 from adverse conditions. Cast iron plates 148 protect the exposed top 60 of concrete structure 58 and provide a fixed seat for plug 146. Plates 148 are preferably pegged to concrete arms 64 by headed pins 150. Also preferably embedded within arms 64 (FIGS. 9 and 11) are thermostatically controlled electric resistance heating elements 152 whose heat output is preferably sufficient to prevent ice formation on moving parts of the present invention. Each horizontal cable 136 preferably has each end connected to a single shock absorber mechanism 78 (FIG. 12). The top cables 136 are connected to the top collars 82, while the complementary bottom cables are connected to the respective bottom collars. Thus, each horizontal cable 136 is attached at each end to its own shock absorbing mechanism 78, providing balanced and shared stopping power to each cable.

Returning to FIGS. 3 and 4, a preferred form of the lift mechanism 70 will now be described. Steel sleeve 74 of bearing sleeve 72 has integrally fixed thereto a lift flange 154, shown as circular in FIG. 3 but which could be of any suitable configuration. It is convenient and practical to make bearing sleeve 72 complete at the factory. Bronze insert 76 is press-fit into steel sleeve 74 and reamed to size, flanges 86 are welded to mounting plate 80 which in turn is welded to sleeve 74, and flange 154 is welded to sleeve 74. The unit is then ready to be brought to the site and simply installed on steel pipe 48 which was previously milled to mate with insert 76.

Lift flange 154 rests on caps 156 of lifting screws 158 of lifting jacks 160. Lifting jacks 160 should preferably be capable of supporting a minimum of 5000 pounds at a screw extension of forty-eight inches and are supplied with motors 162 (FIG. 3) and speed reducers (not shown) which are preferably capable of lifting 3500 points per jack forty-eight inches in twenty seconds. The operation of lifting jacks 160 can conveniently be synchronized through the use of rotary limit switches. Lifting jacks 160 are mounted on base plate 164. Base plate 164 can desirably be welded to steel pipe 48. Integrally depending from base plate 164, and thereby controllably spaced appropriately, are a pair of three inch steel pipes 166 which provide pockets 168 for lifting screws 158. Integrally constructing pipe 48, base plate 164, and pipes 166 prior to removal to the site also simplifies on-site construction, for they can be brought to the site as a unit and simply dropped into place.

Housing 22 is shown in FIGS. 1 and 12 and is preferably a prefabricated enclosure with stainless steel outer panels so that it can withstand even the most rigorous of weather conditions. The side panels of housing 22 may be hinged for easy access, or housing 22 may be a unitary enclosure which is removable from bunker walls 36. Within housing 22 is a stainless steel roll up door 170 which is lifted by net 20 as the latter is raised and which closes automatically due to gravity. Guide rollers 172 facilitate smooth operation of door 170. Door 170 normally closes opening 174 in housing 22 against outside influences. Opening 174 is designed such that net 20, at maximum deflection, will not contact the vertical walls of housing 22 which might cause damage to net, housing, or both. Open pit 38 is covered by a removable grating 176 (FIG. 1) to prevent debris from entering pit 38. Pit 38 and housing 22 will desirably be provided with electric resistance heaters (not shown) whose heat output will be sufficient to prevent ice formation on moving parts of the system.

In operation, a control system (not disclosed) will sense the presence of an oncoming train and will thereby control net operations. Lift motors 162 will be synchronously actuated so that lift screws 158 of lift jacks 160 will raise bearing sleeve 72 and therewith collars 82 and net 20. Should a vehicle crash into net 20, net 20 will deflect, rotating shock absorbing mechanisms 78 about axis 52 of stanchion 32 and compressing hydraulic shock absorbers 84 to restrain the vehicle. All of the restraining forces will act through axis 52, placing the strain upon a massive, immovable support means, namely, a concrete filled steel pipe embedded solidly in a concrete foundation. After the train passes, the control system will reverse motors 162 to lower net 20 into slot 24 of concrete structure or net slot 58. Plug 146 seals slot 24 and restores roadway 10 to its original smooth condition.

Construction of the present invention is simple and economical. In spite of its large mass, bunkers 30 have relatively small footprints requiring comparatively little excavation to install. Once installed, they should be trouble free.

Should repairs to the present invention be necessary, all of the moving parts are readily available without having to dig up anything. Replacement and/or repairs are easily and economically accomplished. Individual parts can be unbolted and replaced. For example, the most likely replacement necessary will be shock absorbers 84 which can be disassembled without even removing collar 82 from stanchion 32. At worst, bearing sleeves 72 with collars 82, shock absorbers 84, and net 20 intact thereon can simply be lifted from stanchions 32 and replaced.

It is clear from the above that the objects of the invention have been fulfilled.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention as defined in the appended claims.

Further, the purpose of the following Abstract is to enable the U.S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

We claim as our invention:

1. A shock absorbing system, comprising:

support means for providing a rigid support for said shock absorbing system, said support means including a solid body having a longitudinal axis, said solid body being rigidly fixed to its immediate surroundings;

shock absorbing means for absorbing forces applied to said shock absorbing system, said shock absorbing means being mounted on said support means to rotate around said solid body and around said longitudinal axis; and force applying means for applying forces to said shock absorbing means, said force applying means being connected to said shock absorbing means such that the applied forces are directed through said solid body regardless of the rotational position of said shock absorbing means relative to said support means.

2. A shock absorbing system according to claim 1, wherein said shock absorbing means is linearly translatable relative to said longitudinal axis.

3. A shock absorbing system according to claim 2, wherein said shock absorbing means is linearly translatable relative to said longitudinal axis substantially orthogonal to said longitudinal axis.

4. A shock absorbing system according to claim 2, wherein said shock absorbing means is linearly translatable relative to said longitudinal axis substantially axially of said longitudinal axis.

5. A shock absorbing system according to claim 2, wherein said shock absorbing means is linearly translatable relative to said longitudinal axis both substantially orthogonal to and substantially axially of said longitudinal axis.

6. A shock absorbing system, comprising:

support means for providing a rigid support for said shock absorbing system, said support means including an axis, a rigid foundation and a cylinder embedded into said foundation, said axis being the axis of said cylinder;

shock absorbing means mounted on said support means for absorbing forces applied to said shock absorbing system, said shock absorbing means being mounted for rotation about said axis of said support means and being linearly translatable relative to said axis; and force applying means connected to said shock absorbing means for applying forces to said shock absorber means, said shock absorbing means being mounted on said support means such that the applied forces act substantially through said axis of said support means.

7. A shock absorbing system according to claim 6, wherein said shock absorbing means comprises a sleeve mounted on said cylinder for axial and rotational movement relative thereto, a collar mounted on said sleeve for orthogonal movement relative thereto, and a shock absorber operatively connected to said sleeve and said collar.

8. A shock absorbing system according to claim 7, wherein said shock absorber is hydraulic and is compressive in response to said applied forces.

9. A ground retractable automobile barrier, comprising:

a roadway;

railroad tracks crossing said roadway;

first and second shock absorbing systems installed respectively on each side of said roadway adjacent said roadway and on both sides of said railroad tracks adjacent said railroad tracks;

restraining means for restraining automobiles from crossing said railroad tracks, said restraining means extending across said roadway between said first and second shock absorbing systems on each side of said railroad tracks;

each of said first and second shock absorbing systems, comprising:

support means for providing a rigid support for said shock absorbing system, said support means including a solid body having a longitudinal axis, said solid body being rigidly fixed to its immediate surroundings;

shock absorbing means for absorbing forces applied to said shock absorbing system, said shock absorbing means being mounted on said support means to rotate around said solid body and around said longitudinal axis; and said restraining means being connected to said shock absorbing means such that said applied forces act substantially transversely through said solid body.

10. A ground retractable automobile barrier according to claim 9, wherein said restraining means comprises a net stretched across said roadway.

11. A ground retractable automobile barrier according to claim 9, wherein said shock absorbing means is linearly translatable relative to said longitudinal axis.

12. A ground retractable automobile barrier according to claim 11, wherein said shock absorbing means is linearly translatable relative to said longitudinal axis substantially orthogonal to said longitudinal axis.

13. A ground retractable automobile barrier according to claim 11, wherein said shock absorbing means is linearly translatable relative to said longitudinal axis substantially axially of said longitudinal axis.

14. A ground retractable automobile barrier according to claim 11, wherein said shock absorbing means is linearly translatable relative to said longitudinal axis both substantially orthogonal to and substantially axially of said longitudinal axis.

15. A ground retractable automobile barrier, comprising:

a roadway;

railroad tracks crossing said roadway;

first and second shock absorbing systems installed respectively on each side of said roadway adjacent said roadway and on both sides of said railroad tracks adjacent said railroad tracks;

restraining means extending across said roadway between said first and second shock absorbing systems on each side of said railroad tracks;

each of said first and second shock absorbing systems, comprising:

support means for providing a rigid support for said shock absorbing system, said support means including an axis, a rigid foundation and a cylinder embedded into said foundation, said axis being the axis of said cylinder;

shock absorbing means for absorbing forces applied to said shock absorbing system, said shock absorbing means being mounted on said support means and being linearly translatable relative to said axis both substantially orthogonal to and substantially axially of said axis; and said restraining means being connected to said shock absorbing means for applying forces to said shock absorbing means, said shock absorbing means being mounted on said support means such that said applied forces act substantially through said axis of said support means.

16. A ground retractable automobile barrier according to claim 15, wherein said shock absorbing means comprises a sleeve mounted on said cylinder for axial and rotational movement relative thereto, a collar mounted on said sleeve for orthogonal movement relative thereto, and a shock absorber operatively connected to said sleeve and said collar.

17. A ground retractable automobile barrier according to claim 6, wherein said shock absorber is hydraulic and is compressive in response to said applied forces.

18. A ground retractable barrier for restraining automobiles on a roadway from crossing railroad tracks that traverse the roadway, comprising:

(a) a shock absorbing system installed on each side of said roadway and on both sides of and adjacent said railroad tracks;

(b) means extending across said roadway bet ween said shock absorbing system for restraining automobiles from crossing said railroad tracks when a train is in the vicinity;

said shock absorbing system comprising:

(i) means, including a longitudinally extending solid body means, for providing a rigid support for said shock absorbing system;

(ii) means, mounted to rotate around said body means, for absorbing shock applied to said shock absorbing system; and (iii) said means for restraining automobiles connected to said means for absorbing shock such that shocks due to restraining automobiles are directed substantially transversely through said solid body.

* * * * *